US005383397A

United States Patent [19]

Battles et al.

[11] Patent Number: 5,383,397

[45] Date of Patent: Jan. 24, 1995

[54] OIL FILTER CRUSHING APPARATUS

[75] Inventors: Timothy J. Battles, Mequon; Harold E. Hollnagel, Milwaukee, both of Wis.

[73] Assignee: KCS Industries Inc., Milwaukee, Wis.

[21] Appl. No.: 100,869

[22] Filed: Aug. 3, 1993

Related U.S. Application Data

[63] Continuation-in-part of Ser. No. 57,580, May 6, 1993, Pat. No. 5,337,656.

[51] Int. Cl.[6] ..... B30B 15/16; B30B 9/02; B30B 1/38

[52] U.S. Cl. ..... 100/51; 100/53; 100/98 R; 100/125; 100/137; 100/266; 100/269 A; 100/902

[58] Field of Search ..... 100/48, 51, 53, 98 R, 100/125, 131, 137, 266, 269 A, 902

[56] References Cited

U.S. PATENT DOCUMENTS

| | | | |
|---|---|---|---|
| 633,665 | 9/1899 | Spaulding | 100/269 A X |
| 877,139 | 1/1908 | Tatarinoff | 100/269 A |
| 2,122,316 | 6/1938 | Ganio | 100/266 X |
| 2,267,662 | 12/1941 | Miller | 100/266 |
| 2,448,314 | 8/1948 | Kavanagh | 100/269 A X |
| 2,737,995 | 3/1956 | Jennings | 100/902 X |
| 2,800,159 | 7/1957 | Walsh et al. | 100/53 |
| 2,982,200 | 5/1961 | Robertson et al. | 100/53 |
| 3,190,215 | 6/1965 | Howard et al. | 100/257 |
| 3,230,812 | 1/1966 | Pucci et al. | 100/269 A X |
| 3,315,594 | 4/1967 | Simshauser | 100/269 A X |
| 3,376,808 | 4/1968 | Beckett et al. | 100/53 |
| 3,648,600 | 3/1972 | Jaccard | 100/266 X |
| 3,763,773 | 10/1973 | Clay | 100/229 A |
| 3,797,293 | 3/1974 | Paramonoff | 100/53 X |
| 4,212,242 | 7/1980 | Willis | 100/902 X |
| 4,240,341 | 12/1980 | Whipple et al. | 100/49 |
| 4,269,114 | 5/1981 | Schwarz et al. | 100/269 A X |
| 4,334,469 | 6/1982 | Tanner et al. | 100/902 X |
| 4,475,449 | 10/1984 | Gianelo | 100/266 X |
| 4,506,578 | 3/1985 | Gaines et al. | 83/583 |
| 4,696,227 | 9/1987 | Van Buskirk | 100/90 |
| 4,927,085 | 5/1990 | Oberg | 241/36 |
| 5,048,413 | 9/1991 | Deiters | 100/226 |
| 5,060,564 | 10/1991 | Buford et al. | 100/52 |
| 5,109,763 | 5/1992 | Morris et al. | 100/48 |
| 5,174,199 | 12/1992 | King et al. | 100/53 X |
| 5,188,022 | 2/1993 | Benson et al. | 100/902 X |

FOREIGN PATENT DOCUMENTS

| | | | |
|---|---|---|---|
| 136539 | 11/1902 | Germany | 100/125 |
| 1-205899 | 8/1989 | Japan | 100/269 A |
| 15589 | 11/1887 | United Kingdom | 100/269 A |
| 1237688 | 6/1971 | United Kingdom | 100/125 |
| 2169838 | 7/1986 | United Kingdom | 100/902 |
| 597568 | 3/1978 | U.S.S.R. | 100/269 A |

*Primary Examiner*—Stephen F. Gerrity
*Attorney, Agent, or Firm*—Foley & Lardner

[57] ABSTRACT

An oil filter crushing apparatus includes a frame on which is mounted a filter platform configured to receive a used oil filter for crushing. An air spring actuating device is secured within the frame, and a ram is secured to a lower end of the air spring. A control valve regulates the flow of a pressurized gas into the air spring which then forces the ram toward the filter platform to crush the filter. A safety pneumatic circuit prevents inadvertent actuation of the ram.

21 Claims, 9 Drawing Sheets

OIL FILTER CRUSHING APPARATUS

This is a continuation-in-part of U.S. Ser. No. 08/057,580, filed on May 6, 1993, now U.S. Pat. No. 5,337,656.

TECHNICAL FIELD

This invention relates generally to an apparatus for crushing objects and particularly to oil filter presses used for crushing spent oil filters to extract residual oil therefrom prior to disposal.

BACKGROUND OF THE INVENTION

Oil filter presses have been proposed for crushing spent disposable-type oil filters commonly used on automobiles and trucks in order to reclaim residual oil from the filters before disposal. Examples of prior art oil filter presses include those disclosed in the U.S. Pat. No. 4,927,085 to Oberg, granted May 22, 1990; U.S. Pat. No. 5,060,564 to Bufford et al, granted Oct. 29, 1991; and U.S. Pat. No. 5,109,763 to Morris et al, granted May 5, 1992.

To be of practical value to small automotive service stations and oil change facilities, an oil filter press must be compact, simply constructed, low cost, and reliable. The known prior art filter presses utilize a fluid power cylinder to actuate an oil filter crushing device. Such fluid cylinders, however, are costly, complex, and often require periodic maintenance of fluid seals.

Another device disclosed in Clay, U.S. Pat. No. 3,763,773 uses an expandable bellows which is filled with water, the weight of which supplies the force necessary to compact trash. Using water filled bellows, however, would be too slow and impractical for crushing oil filters or the like where rapid, repetitive actuation is required potentially to crush relatively large numbers of oil filters.

SUMMARY OF INVENTION AND ADVANTAGES

An apparatus, according to the present invention, crushes used oil filters and the like to reclaim residual oil therefrom before disposing of the filters. The apparatus comprises a rigid frame having a base for supporting an oil filter on end; a ram having a rod slidably supported by the frame for longitudinal movement toward and away from the base and a crushing head secured to a lower end of the rod above the base for engaging and crushing the oil filter. The ram is moved by an inflatable air bag or air spring secured to the frame. The air spring selectively receives a pressurized actuating gas which causes it to expand between the frame and the ram. This displaces the crushing head from a raised unactuated position to a lowered actuated position toward the base, thus crushing the filter interposed between the crushing head and the base.

The oil filter crushing apparatus of this invention utilizes the self-contained air spring rather than a fluid cylinder to simplify the construction, reduce the cost and minimize maintenance requirements. Hence, this crushing apparatus is more suitable for use by small service stations and oil change facilities.

According to another aspect of this invention, a housing is disposed about the ram and air spring to prevent inadvertent contact between a user and the moving parts. The housing includes an opening through which the oil filter is placed upon or removed from the base. A door is pivotably disposed in the opening and interacts with a pneumatic circuit which prevents gas from entering the air spring unless the door is in its closed position. This ensures safe operation of the crushing apparatus.

BRIEF DESCRIPTION OF THE DRAWINGS

The invention will hereafter be described with reference to the accompanying drawings, wherein like numerals denote like elements, and.

DETAILED DESCRIPTION OF THE PREFERRED EMBODIMENTS

Figure 1:
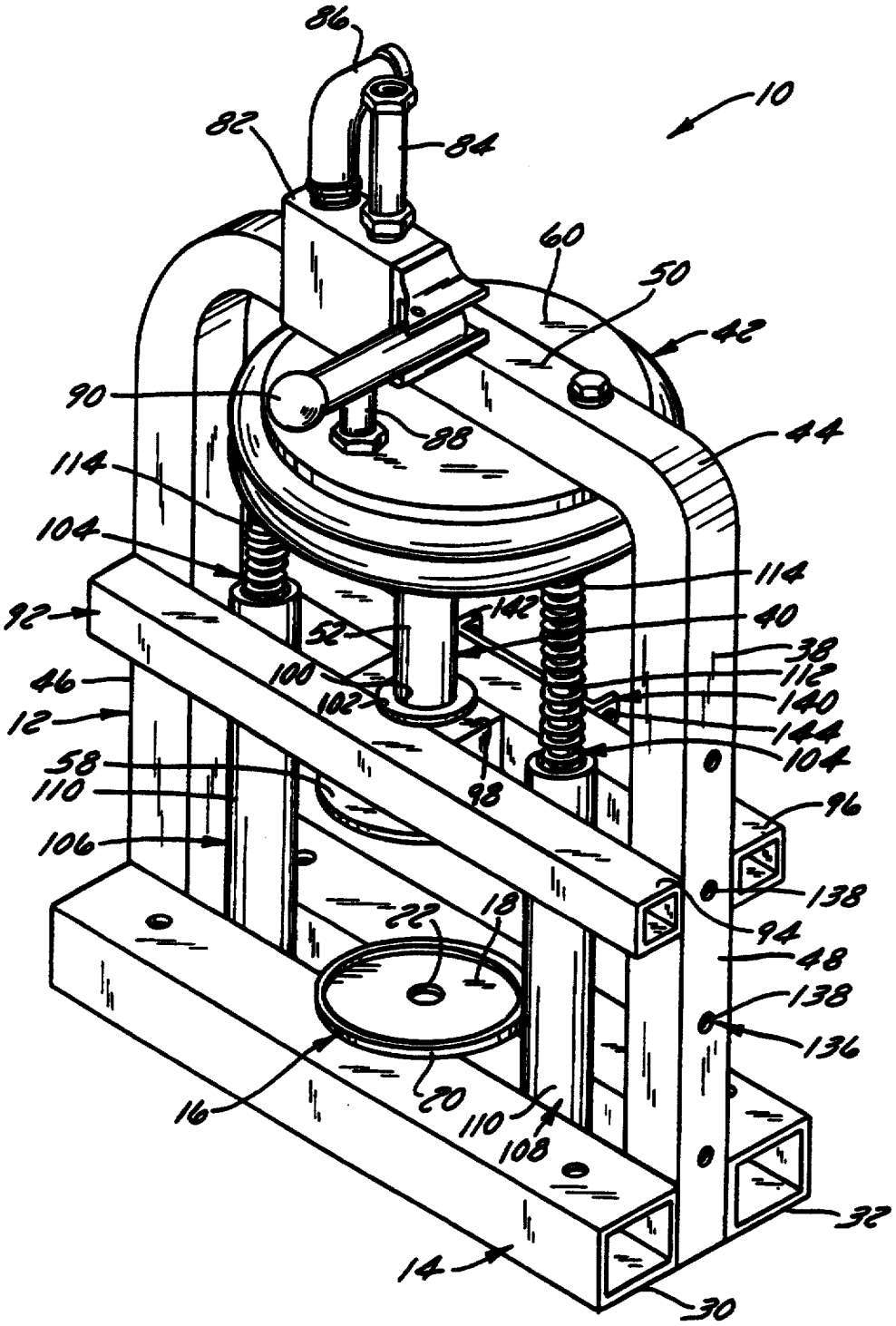
FIG. 1 is a perspective view of a first embodiment of the invention.

An oil filter crushing apparatus or press constructed according to a first embodiment of the invention is generally indicated at 10 in FIGS. 1–5. Press 10 is preferably used to crush spent disposable oil filters of the type normally used in automotive and light truck engine applications and to reclaim residual oil therefrom before disposing of the filter. A representative oil filter is indicated in the drawings by the reference numeral 11.

Figure 2:
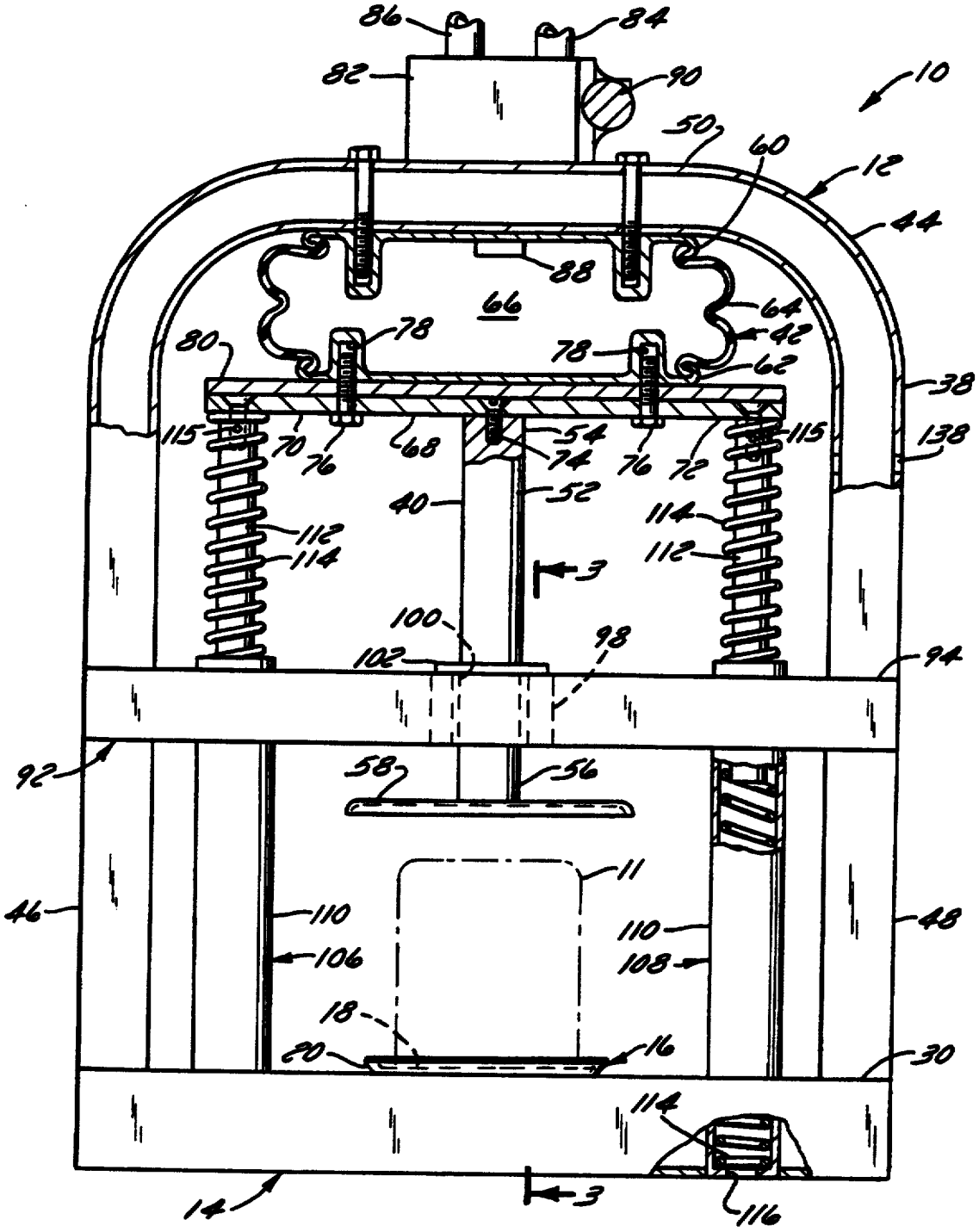
FIG. 2 is a side elevation view of the press of FIG. 1, shown partly in section.

Filter press 10 includes a rigid frame 12 having a base 14 for supporting filter 11 on end as shown in FIG. 2. Base 14 preferably includes a disc-shaped circular filter platform 16 which has a horizontally disposed upper surface 18 on which filter 11 rests. The perimeter of platform 16 is provided with an upturned lip or ridge 20 to assist in properly positioning filter 11 and to prevent filter 11 from sliding off the platform during crushing. Platform 16 includes a central drain aperture 22 and a drain hose fitting 24 for connection with a drain line 26 (see FIG. 3). A reservoir (not shown) may be provided directly below platform 16 to collect the residual oil discharged through aperture 22 or, alternatively, a remote collection reservoir (not shown) may be provided to receive the oil discharged through line 26.

To mount filter 11 on platform 16, the operator of press 10 simply positions filter 11 on end on the platform so the filter's peripheral lip seal (not shown) engages upper surface 18 of platform 16 to seal filter 11 against leakage of the residual oil during crushing except through drain port 22. In this way, filter 11 is supported on end with the lower open end of the filter against the upper surface 18 of platform 16, while the side walls of the filter casing extend generally vertically upward.

Figure 3:
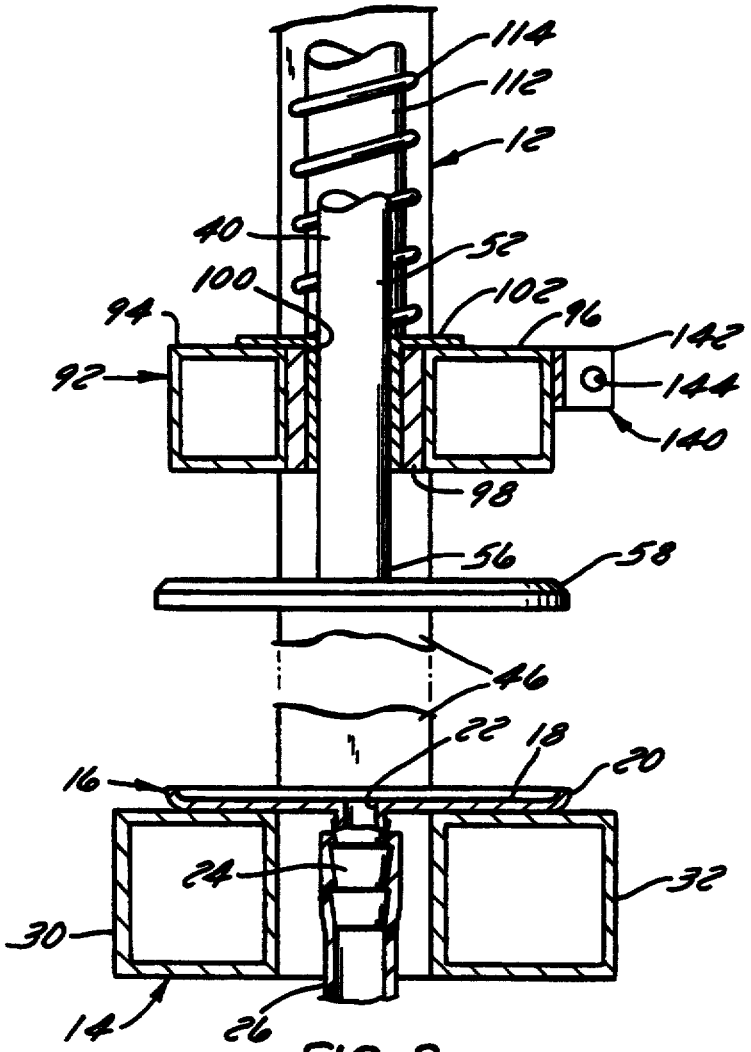
FIG. 3 is a cross-sectional view taken generally along line 3—3 of FIG. 2.
Figure 4:
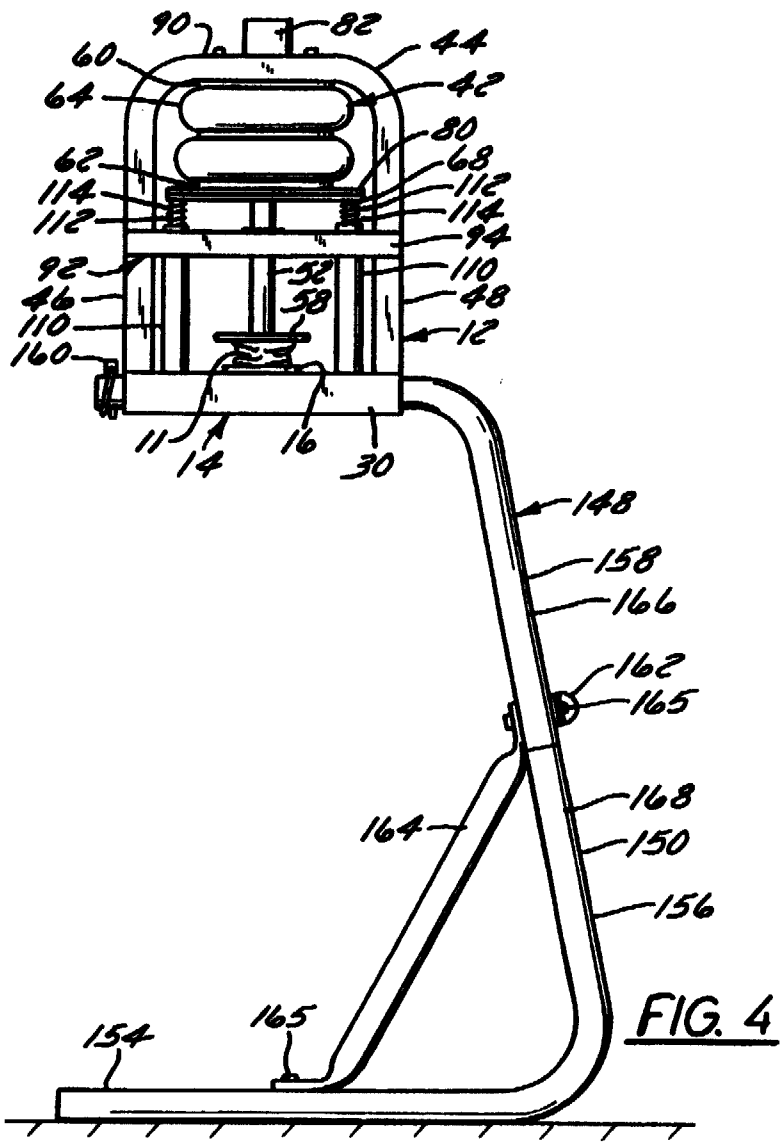
FIG. 4 is a front elevation view showing the crushing apparatus with an optional stand.

As best viewed in FIGS. 1 and 3, base 14 includes a front mounting member 30 and a back mounting member 32. The mounting members are preferably of tubular metal construction and extend generally horizontally at a spaced distance from and generally parallel to each other. Mounting members 30, 32 support platform 16 which spans a gap between mounting members 30, 32 and is supported directly by the upper surface of mounting members 30, 32 as best seen in FIG. 4. The platform 16 may be permanently secured to mounting members 30, 32 by welding, for example, or otherwise are fixed in position. Drain port 22 is positioned in the gap between the mounting members 30, 32. The mounting members, 30, 32 are preferably constructed of square tubular metal stock.

Frame 12 includes an upper support frame portion 38 secured to and rigidly supported by base 14. A ram 40 and an air spring 42 are mounted to frame 12. Air spring 42 is a self-contained unit which includes an elastic flexible portion which expands when a pressurized gas is introduced into air spring 42. Upper support frame portion 38 includes a single U-shaped tubular member 44 which is preferably constructed from a single piece of tubular metal stock bent into the general shape of a U having a left leg 46 and a right leg 48 vertically upstanding and generally parallel. A horizontally disposed top connecting portion 50 extends between the legs and integrally joins them to one another. U-shaped tubular member 44 is supported in an inverted fashion with the free ends of leg portions 46, 48 extending into the gap between mounting members 30, 32. Tubular member 44 is rigidly secured to mounting members 30, 32 by welding or any other suitable connecting means. In this manner, leg portions 46, 48 extend vertically up from base 14 and support top connecting portion 50 at a spaced position above base 14.

Ram 40 preferably has a single ram rod or shaft 52 constructed of solid round metal bar stock that extends vertically between an upper end 54 and a lower end 56. Ram rod 52 is located approximately midway between the left and right leg portions 46, 48 of U-shaped tubular member 44. A crushing head 58 is secured to lower end 56 of ram rod 52 directly above filter platform 16. Crushing head 58 is configured to engage the top end of the filter 11 during crushing.

Air spring 42 is disposed between upper end 54 of ram rod 52 and top portion 50 of U-shaped tubular member 44. Air spring 42 is preferably a double convolute Enidine Air Spring, Model No. YI-2B12, manufactured by Goodyear Tire and Rubber Co., and includes an upper plate 60 and a lower plate 62 which are secured to top portion 50 and upper end 54 of ram rod 52, respectively. A flexible member 64 is connected in sealing engagement between upper plate 60 and lower plate 62 to define an enclosed expandable chamber 66 into which a pressurized actuating gas may be introduced to expand the chamber 66 and actuate ram 40.

A pressing plate 68 is secured to ram rod upper end 54 and extends horizontally between a left end 70 and a right end 72 which are spaced inwardly of leg portions 46, 48 of U-shaped member 44. Pressing plate 68 is preferably fabricated of rectangular metal plate material and is secured to ram rod 52 by a machine screw 74 or other suitable fastener. Lower plate 62 of air spring 42 is fastened to pressing plate 68 by a pair of machine screws 76 which extend through corresponding apertures in pressing plate 68 and are threaded into blind threaded mounting taps 78 of lower end plate 62. In the illustrated embodiment, an inertia plate 80 is disposed between pressing plate 68 and lower plate 62 of air spring 42. Inertia plate 80 may be fabricated of steel plate material, while plates 60, 62 are preferably fabricated from aluminum. The weight of inertia plate 80 depends on the particular application, but a weight of about five (5) pounds works well in most situations.

Inertia plate 80 engages substantially the entire lower surface of lower plate 62 and distributes the crushing force of air spring 42 more evenly across pressing plate 68. It also prevents the portions of lower plate 62 extending beyond pressing plate 68 from bending around pressing plate 68 under a filter-crushing load. Inertia plate 80 extends between left end 70 and right end 72 of pressing plate 68 and then bulges outwardly between its ends to support substantially the entire lower plate 62.

Air spring 42 includes a valve 82 having a supply line inlet 84, a discharge line 86, and a gas inlet line 88 extending between valve 82 and chamber 66 of air spring 42. Supply line 84 is coupled to pressurized gas supply (not shown), typically a low pressure air supply line (i.e., shop air) available in most automotive service stations and oil change facilities. Shop air is typically pressurized to 110 psi. A control lever 90 is normally maintained in an off position to prevent the pressurized air from entering chamber 66 and actuating ram 40. Upon moving control lever 90 to an on position, however, valve 82 directs the pressurized air into chamber 66, causing it to expand via flex member 64. This, in turn, displaces lower plate 62 downward and moves ram 40 away from an initial raised unactuated position (shown in FIGS. 1 and 2) in which crushing head 58 is spaced above platform 16 a sufficient distance to enable an uncrushed oil filter 11 to be placed on platform 16. Crushing head 58 continues to move toward a lowered actuated position (shown in FIGS. 4 and 5) where ram 40 is in proximity with base 14, thus crushing oil filter 11 between crushing head 58 and platform 16.

Preferably, air spring 42 is secured to frame 12 and ram 40 by threaded fasteners so it may readily be detached for repair or replacement. It is a self-contained separable component of apparatus 10 which simplifies the construction and lowers the cost of the apparatus 10.

Frame 12 also includes a ram rod support brace 92 welded or otherwise secured to leg portions 46, 48 of U-shaped member 44 intermediate top portion 50 and base 14. Support brace 92 extends horizontally inwardly of leg portions 46, 48 to slidably guide and support ram rod 52 during vertical movement thereof between the unactuated and actuated positions. Support brace 92 includes a front cross member 94 and a back cross member 96, each preferably constructed of square tubular metal stock material and welded or otherwise rigidly secured to left leg 46 and right leg 48 on opposite front and back sides of ram rod 52, respectively. Support brace 92 includes a guide member 98 which is connected to cross members 94, 96 and spans the gap between cross members 94, 96. Guide member 98 includes a central passageway 100 through which ram rod 52 slidably extends. A low friction sleeve-like bearing or bushing 102 is preferably disposed in the passageway 100. Bushing 102 provides a low friction bearing surface between ram rod 52 and guide member 98. A preferred bearing is available commercially through Garlock Bearings, Inc., Part No. 20DU28. Support brace 92 enables the use of a single ram rod which further simplifies the structure and reduces cost.

Frame 12 also includes return members 104 acting between ram 40 and base 14 in opposition to air spring 42 to constantly urge ram 40 upwardly toward the unactuated raised position. Return members 104 preferably comprise a pair of spring loaded telescopic guides 106, 108 disposed on opposite sides of ram rod 52 and connected between pressing plate 68 of ram 40 and base portion 14 of frame 12. Each telescopic guide 106, 108 includes a cylindrical guide sleeve 110, a cylindrical plunger rod 112 extending into the sleeve, and a compression coil spring 114 carried about the plunger rod 112 and extending into the sleeve 110. As best shown in FIG. 2, plunger rods 112 are secured to the corresponding left and right ends 70, 72 of pressing plate 68 by machine screws. The machine screws are preferably held in place by a pin, such as roll pin 115 disposed generally vertically in a notched out portion between each machine screw and pressing plate 68. From there, plunger rods 112 extend vertically downward toward base 14. Telescopic guides 106, 108 are preferably spaced inwardly of leg portions 46, 48 of U-shaped member 44.

Guide sleeves 110 are welded or otherwise secured to base 14 and extend vertically upward therefrom between front cross member 94 and back cross member 96. Guide sleeves 110 are further welded or otherwise secured to cross members 94, 96. A lower end of each guide sleeve 110 is rolled inwardly to form a spring seat flange or lip 116. The lower end of each coil spring 114 is supported on spring seat 116 and the upper end of each coil spring 114 bears against an underside of pressing plate 68. Each plunger rod 112 extends into the upper open end of its respective guide sleeve 110 and is slidably supported by the sleeve 110 during movement of ram 40. Coil springs 114 react between spring seat 116 and pressing plate 68 to constantly urge ram 40 upward to the unactuated position. Thus, upon actuation of ram 40, plunger rods 112 move further into guide sleeves 110 increasing the compression load on springs 114. Then, upon deactuation of ram 40, springs 114 return ram 40 to the raised unactuated position.

Press 10 may optionally include filter sidewall deforming members which are movable transversely to ram 40 to engage and inwardly deform the sidewalls of oil filter 11. This reduces the filter's initial peak resistance to end-to-end crushing. The filter sidewall deforming members 118 are operatively coupled to ram 40 and move transverse to the filter sidewall in response to downward movement of ram 40.

Figure 7:
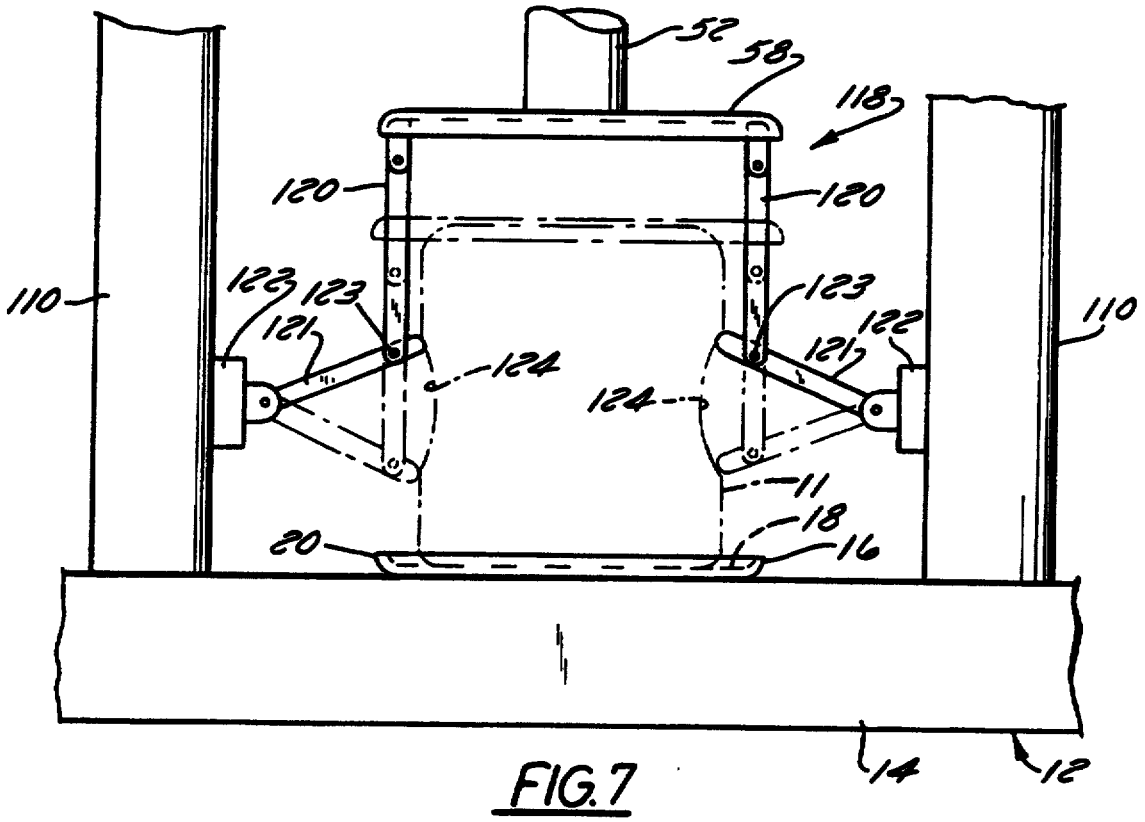
FIGS. 7 and 8 are fragmentary front elevation views showing alternative embodiments of a filter sidewall crushing feature.
Figure 8:
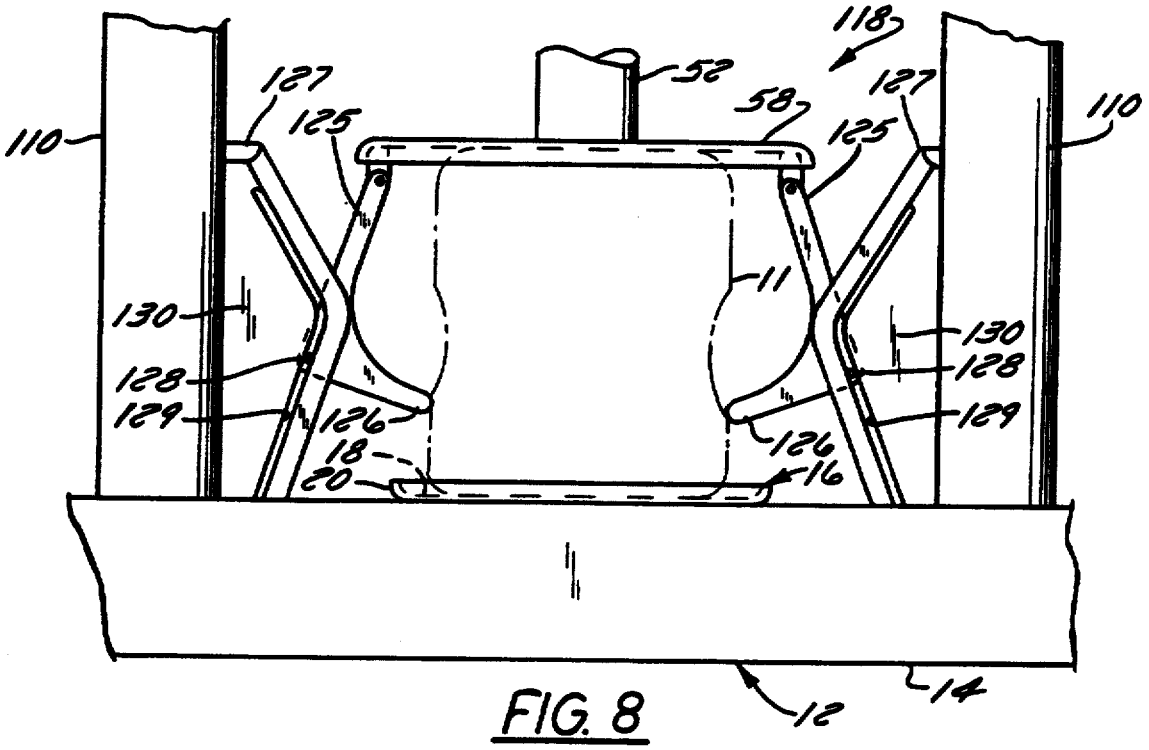

Two separate embodiments of the filter sidewall deforming members 118 are shown in FIGS. 7 and 8, respectively. In the embodiment of FIG. 7, a pair of first link members 120 are pivotally connected to crushing head 58 on opposite sides of ram rod 52 and extend generally vertically downward therefrom toward base 14 on either side of filter 11. A pair of second link members 121 are each pivotally connected at one end to a support block 122 mounted on the outer surface of the adjacent guide sleeve 110. Each second link member 121 extends inwardly toward ram rod 52 and is connected to the cooperating first link member 120 at a connection point 123, preferably a pivot connection point. Thus, downward movement of ram 40 produces downward pivotal movement of each second link member 121, forcing its inwardmost end along an inwardly arching path to produce a dent or deformation 124 in filter 11 prior to commencement of end-to-end crushing. First and second link members 120, 121 swing free of oil filter 11 and move out of the way once end-to-end crushing commences (see phantom lines in FIG. 7).

In FIG. 8, another embodiment of sidewall deforming members 118 is illustrated. A pair of first link members 125 are pivotally connected to crushing head 58 and extend generally downward toward base 14. First link members 125 are generally L-shaped and each includes a filter-engaging foot portion 126 projecting inwardly on either side of filter 11. A pair of second link members 127 each comprise a cam plate 130 welded or otherwise secured to the frame, preferably the outer surface of the adjacent guide sleeve 110. Each first link member 126 includes a follower pin 128 projecting therefrom and received in a cooperating cam slot 129 of second link members 127. As ram 40 moves from the initial raised unactuated position toward the lower actuated position, the interaction between follower pins 128 and cam slots 129 causes foot portions 126 of first link members 125 to move toward one another. This causes inward deformation of the filter sidewalls, after which link members 125 move outwardly from the filter to avoid interference with the end-to-end crushing operation.

Frame 12 may further optionally include a wall mount 136 for mounting apparatus 10 on a wall. Wall mount 136 may include one or more mounting holes or apertures 138 provided in one or both of the leg portions 46, 48 as shown in FIGS. 1 and 2. Holes 138 are configured to receive suitable fasteners or other mounting hardware to secure press 10 to the wall. A mounting bracket 140 may also be secured to the frame for connection with a suitable mounting fixture (not shown) along the wall. As shown in FIGS. 1 and 3, mounting bracket 140 is preferably secured to one of the cross members 94 or 96 and may comprise a generally U-shaped metal channel including a pair of outwardly projecting mounting tabs or ears 142 provided with mounting holes 144 for attachment to the wall fixture (not shown). The filter press 10 may be provided with one or both embodiments of the wall mount.

Frame 12 may also include, either alternatively or in addition to the wall mount 136, a barrel mount which, in the preferred form, is a series of apertures similar to those of the wall mount 136 but extending through either one or both of the tubular mounting members 30, 32 of base portion 14. The apertures are arranged to receive fasteners or other suitable mounting hardware for mounting the press 10 to an oil collection barrel or drum (not shown).

Figure 5:
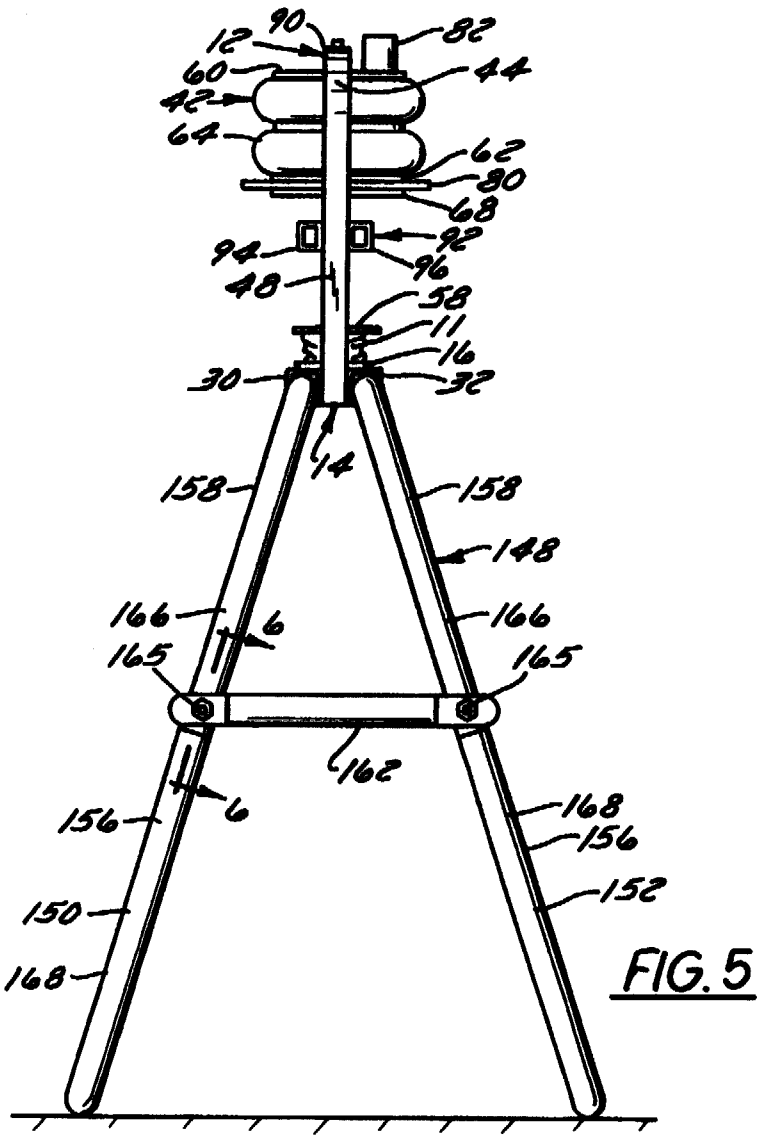
FIG. 5 is a side elevation view showing the crushing apparatus with an optional stand.

Alternatively, press 10 includes a floor stand 148. As shown in FIGS. 4 and 5, floor stand 148 preferably includes a pair of generally C-shaped members 150, 152 each having a lower foot portion 154 for contacting the floor or other support surface, a support arm portion 156 attached above foot portion 154, and an upstanding leg portion 158 extending between foot 154 and support arm portions 156. Support arms 156 preferably extend into the tubular mounting members 30, 32 of frame 12 to hold filter press 10 above the floor. The C-shaped members 150, 152 are preferably fabricated of round tubular metal stock material. As illustrated in FIG. 4, a retainer pin 160 may be provided through at least one support arm 156 to secure press 10 on stand 148.

As shown best in FIG. 5, C-shaped members 150, 152 are connected to one another by a crosspiece 162 to provide lateral stability to floor stand 148. Additionally, a stabilizing member 164 extends between leg portion 158 and foot portion 154 of each of the C-shaped members to provide fore and aft stability.

Figure 6:
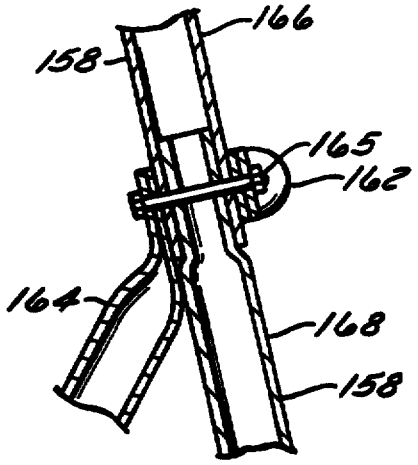
FIG. 6 is a fragmentary sectional view taken generally along lines 6—6 of FIG. 5.

Floor stand 148 is preferably constructed to be collapsible. In particular, crosspiece 162 and stabilizing members 164 are secured by removable fasteners 165. Further, leg portions 158 are preferably formed as a separable upper section 166 and a lower section 168, best illustrated in FIG. 6. As shown, lower leg section 168 has a reduced diameter end which fits into the adjacent open end of upper leg section 166. The crosspiece 162, stabilizing member 164, and upper and lower leg sections 166, 168 have aligned apertures through which common fasteners 165 extend. In this way, fasteners 165 couple crosspiece 162 and stabilizing members 164 to leg portions 158 while simultaneously coupling upper leg sections 166 to lower leg sections 168.

An alternate embodiment of filter press 10 is shown in FIGS. 9–14. This embodiment is specifically designed to shroud the area in which the oil filters are crushed to prevent injury from inadvertent placement of a finger or other body part during the filter crushing operation. In fact, in this embodiment air flow into air spring 42 is prohibited until the oil filter crushing area is sealed off.

Figure 10:
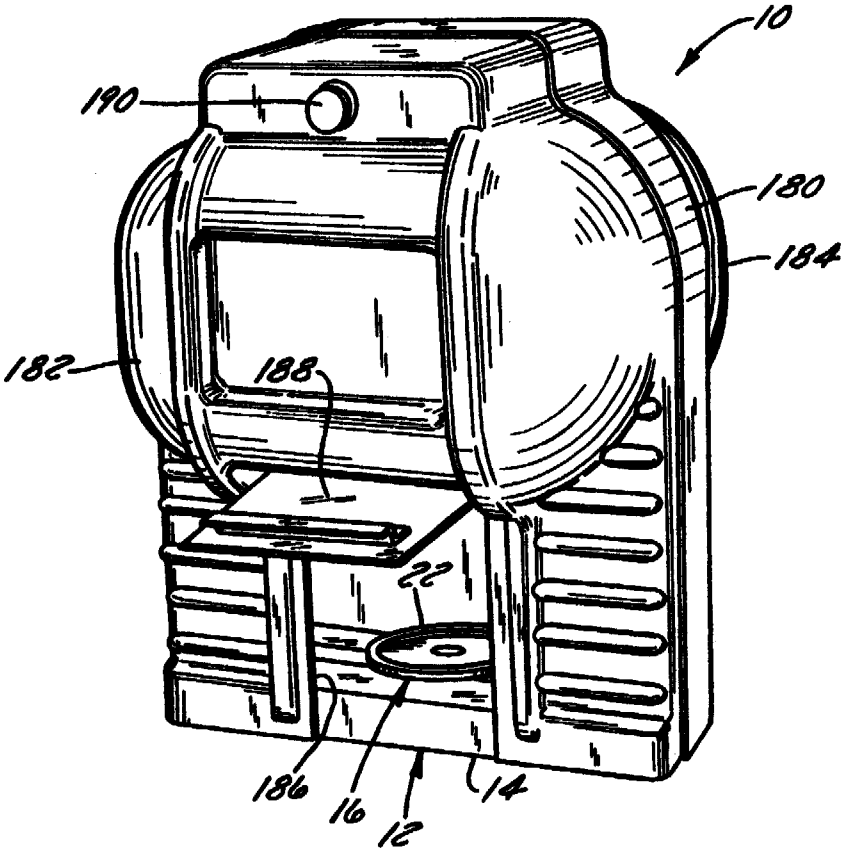
FIG. 10 is a front perspective view of the alternate embodiment of the crushing apparatus showing the door in an open position.
Figure 9:
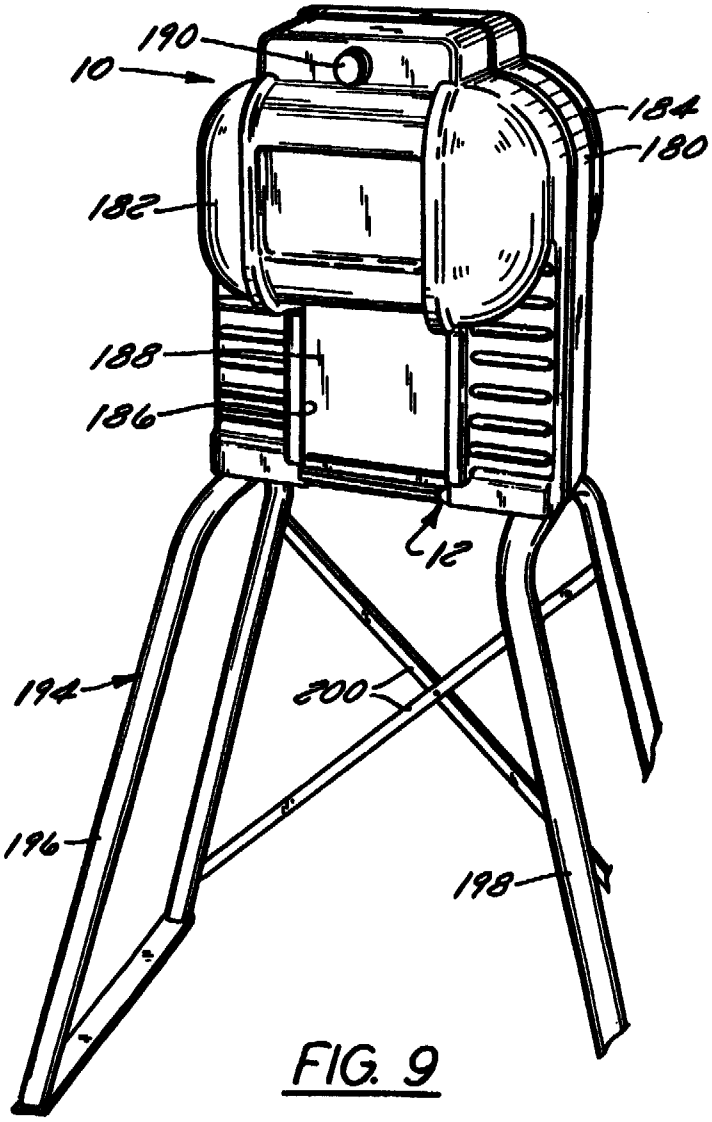
FIG. 9 is a perspective view of an alternate embodiment of the crushing apparatus.
Figure 11:
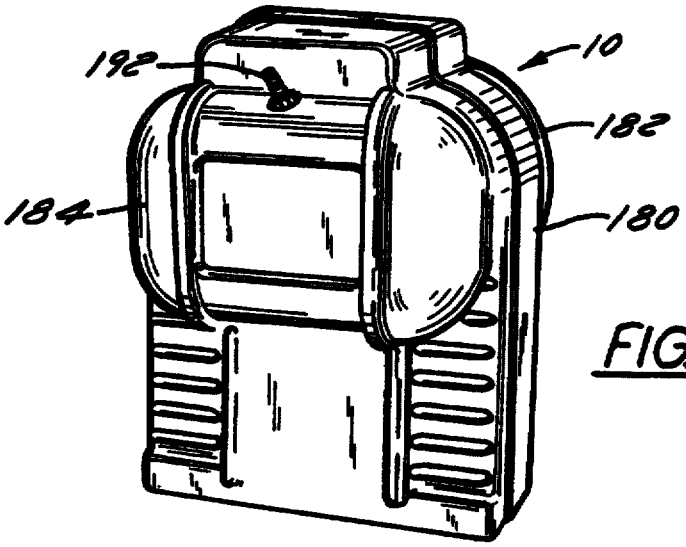
FIG. 11 is a rear perspective view of the alternate embodiment shown in FIGS. 9 and 10.
Figure 12:
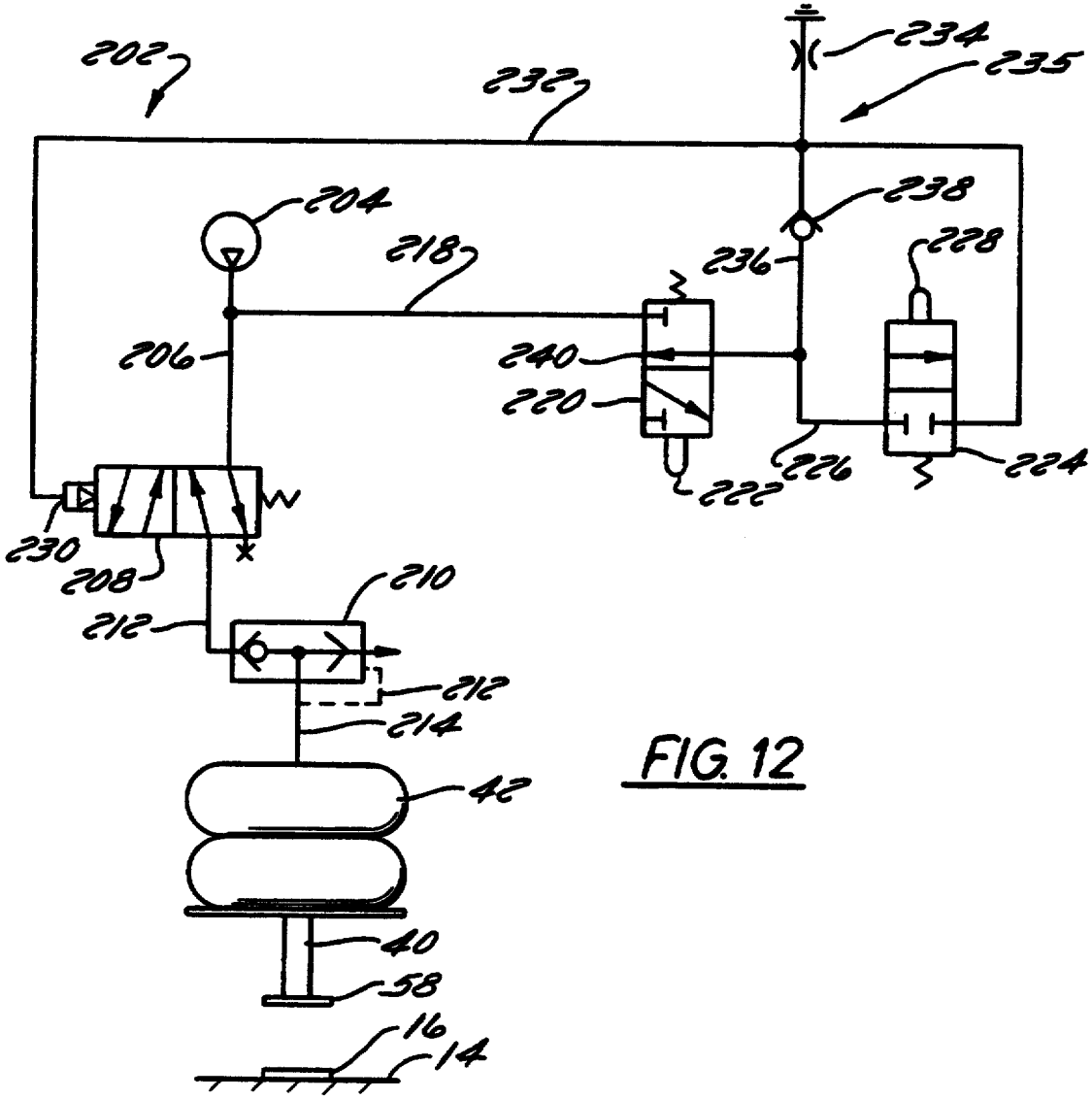
FIG. 12 is a schematic diagram of the pneumatic circuit used to operate an air spring of the filter press.

As shown in FIGS. 9–11, press 10 includes a housing 180 having a front portion 182 and a back portion 184. Housing 180 also includes an opening 186 through which oil filters may be placed on filter platform 16 prior to crushing and through which the crushed oil filters may be removed. A door 188 is disposed in opening 186 and is appropriately mounted for pivotable movement between an open position, allowing insertion and removal of the filters through opening 186, and a closed position which prevents access to the filter crushing area during the crushing operation. To operate this embodiment of press 10, door 188 is opened, an oil filter is placed on filter platform 16, door 188 is closed, and an actuator button 190 extending through housing 180 is pressed to initiate downward movement of ram 40 and the crushing of the oil filter. Air is supplied to actuate ram 40 through a gas inlet 192 extending through housing 180 and configured for connection to a shop air line (not shown).

As illustrated in FIG. 9, press 10 optionally includes a stand 194 having a first support member 196 and a second support member 198. Support members 196 and 198 are preferably attached to frame 12 at a distance spaced from door 188 to provide stability and support and to allow easy access to door 188. Additionally, a pair of cross supports 200 are attached between first and second support members 196, 198 to stabilize stand 194.

One of the unique aspects of this embodiment of filter press 10 is a pneumatic circuit 202 interconnected between door 188, actuator button 190, and gas inlet 192 to prevent potentially unsafe operation of press 10 while door 188 is open. Pneumatic circuit 202 is shown schematically in FIG. 12.

As illustrated, pneumatic circuit 202 is connected to an air supply 204, typically through gas inlet 192. An air line 206 connects air supply 204 with a pneumatically actuated supply valve 208, preferably a multi-purpose valve supplied by the Mead Company, Model No. F-38 N2-SP. Supply valve 208 is connected to a quick exhaust valve 210 by an air line 212, and quick exhaust valve 210 is connected to air spring 42 by an air line 214. Valve 210 is preferably of the type distributed by the Mead Company as Model No. 2B QEV. The noise of gas escaping through valve 210 may be lessened by attaching a muffler 216, preferably a Model P38 distributed by Allied Witan Company. When supply valve 208 is actuated, air flows from supply 204 through supply valve 208, through quick exhaust valve 210, and into air spring 42, thus inflating air spring 42 and forcing ram 40 against the oil filter.

Pneumatic circuit 202 further includes various safety features which prevent inadvertent actuation of supply valve 208. An air line 218 connects air line 206 with a valve 220 which is preferably a three-way valve mounted to frame 12 in proximity to door 188. The door valve 220 includes a push button 222 which interacts with door 188 to move valve 220 to an actuated position when door 188 is closed and to an unactuated position when door 188 is open. Valve 220 is connected to a second valve 224, preferably a two-way valve, by an air line 226. Valve 224 is a push button type valve and includes a push button 228 which is connected to actuator button 190. When a person using apparatus 10 presses actuator button 190, valve 224 is moved to an open or actuated position, and when the user releases actuator button 190, valve 224 returns to a closed position. Preferably, three-way valve 220 and two-way valve 224 are of the type distributed by SMC Pneumatics Inc. under Model Nos. NVM130-N01 and NVM120-N01, respectively.

Valve 224 is connected to an actuator port 230 of supply valve 208 by an air line 232. When air line 232 is sufficiently pressurized, supply valve 208 is actuated, allowing air to pass from air supply 204 to air spring 42. Once the pressure in air line 232 decreases to a pressure less than the required actuation pressure, supply valve 208 returns to its closed position. A bleed orifice 234, such as the Model F-950-5-041-B80 filter distributed by Air Logic Pneumatic Components and Systems, is connected to air line 232 to release the pressure from air line 232 at a controlled rate. Thus, once air pressure is introduced into air line 232 and valve 224 is closed, supply valve 208 will remain actuated until the pressure in line 232 is sufficiently reduced by the release of air through bleed orifice 234. Once supply valve 208 is deactivated, the air in air spring 42 is released through quick exhaust valve 210 and ram 40 returns to its unactuated position. Thus, bleed orifice 234 and air line 232 work together as a pneumatic timer 235. By varying the length of air line 232 and the size of bleed orifice 234, the amount of time it takes to deactuate supply valve 208 can be adjusted. Thus, by a simple pressing of actuator button 190, apparatus 10 will cycle by itself, e.g. crush the oil filter and return to its unactuated position.

A safety air line 236 is connected between air line 232 and air line 226 which extends between valves 220 and 224. Air line 236 includes a check valve 238 which only allows air flow in the direction from air line 232 to air line 226. This combination of air line 236 and check valve 238 provides a safety feature which stops the advance of ram 40 if door 188 is opened during the crushing process. If line 232 is sufficiently pressurized to actuate supply valve 208, air will be filling air spring 42 and forcing ram 40 against the oil filter. However, if during this operation, door 188 is opened, it will force valve 220 to its unactuated position, allowing the air in safety air line 236 and pressurized air line 232 to rapidly escape through exhaust port 240 of valve 220. This deactivates supply valve 208 and prevents further inflation of air spring 42.

The operation of pneumatic circuit 202 is best explained in conjunction with the description of crushing an oil filter, such as oil filter 11. First, a filter 11 is inserted through housing opening 186 and placed on filter platform 16. Door 188 is then closed, which moves valve 220 to its actuated position, i.e. the position which allows air flow from air line 218 to air line 226. Actuator button 190 is then depressed which, in turn, moves valve 224 to its actuated position until button 190 is released. (Valve 224, in its actuated position, allows air flow from air line 226 to air line 232.) When valves 220 and 224 are both actuated, pressurized air freely flows from supply 204 and pressurizes air line 232. This, in turn, actuates supply valve 208, allowing pressurized air to flow from air supply 204 directly through supply valve 208, through quick exhaust valve 210, and into air spring 42, thus inflating air spring 42. While supply valve 208 remains in its actuated position, air is continually supplied to air spring 42, moving ram 40 to its actuated or filter crushing position. Meanwhile, button 190 has been released and bleed orifice 234 is releasing air from air line 232 which lowers the pressure at actuator port 230 of supply valve 208. Once the pressure in air line 232 is sufficiently low (preferably 7–10 seconds after button 190 is released), supply valve 208 is deactuated and the air in air spring 42 is quickly exhausted to atmosphere through exhaust valve 210. However, if door 188 is opened during this crushing operation, valve 220 is returned to its unactuated position, which allows the air in air lines 232 and 236 to rapidly escape through exhaust port 240. This quickly drops the pressure at actuator port 230 of supply valve 208, whereupon the air in air spring 42 is exhausted through quick exhaust valve 210.

Figure 13:
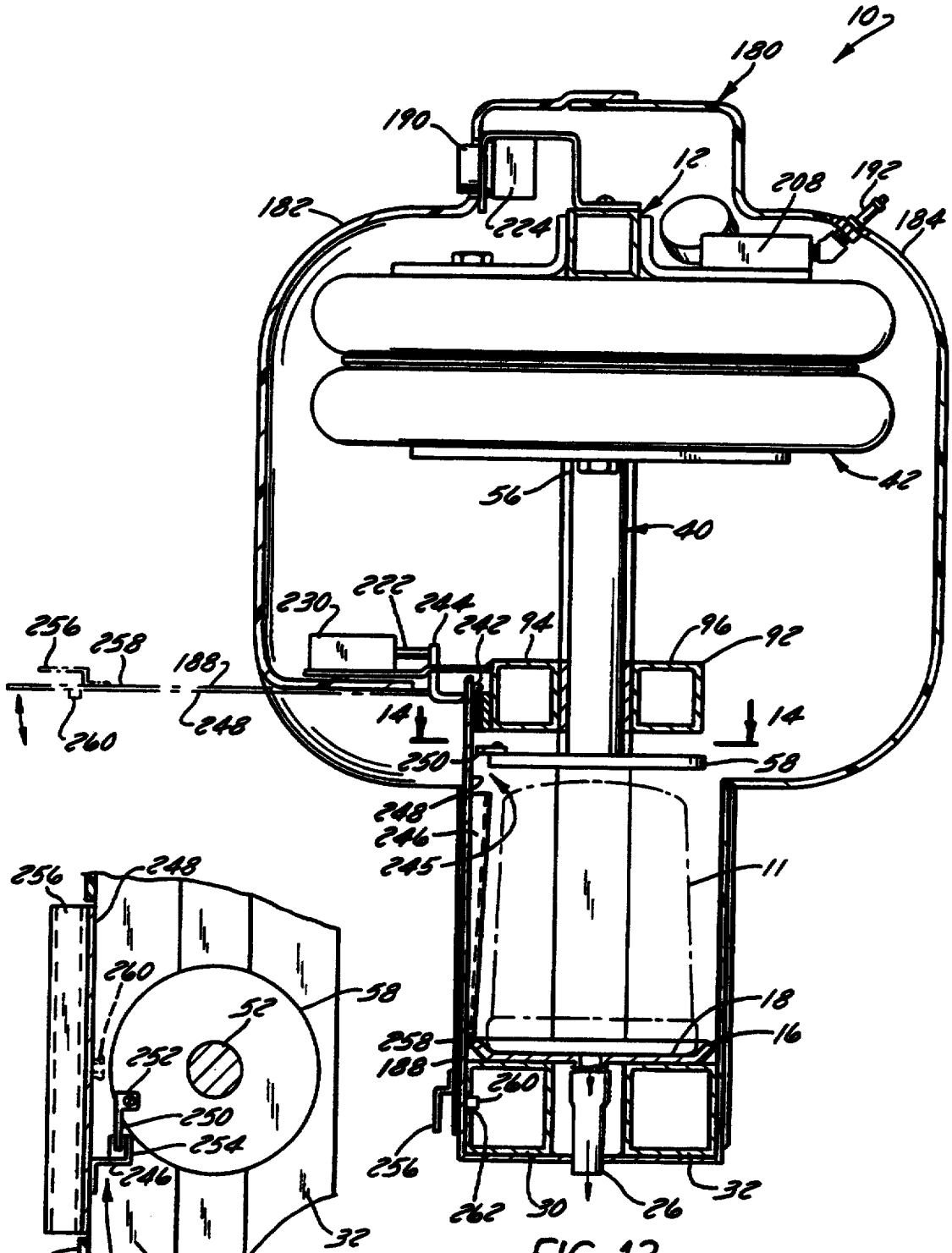
FIG. 13 is a side view of the alternate embodiment taken in partial cross-section.
Figure 14:
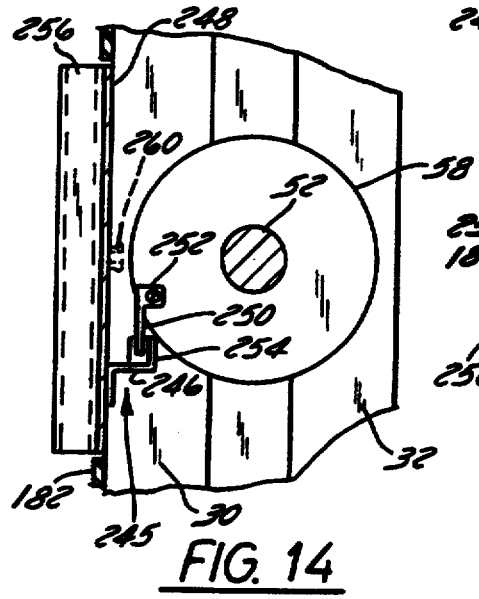
FIG. 14 is a cross-sectional view taken generally along line 14—14 of FIG. 13.

The interaction of door 188 with valve 220 is further illustrated in FIG. 13. As shown, door 188 is pivotably mounted on frame 12 by a hinge 242. An extension 244 is attached to door 188, preferably in proximity to hinge 242, and is configured for interaction with push button 222 of valve 220. When door 188 is closed, extension 244 presses push button 222 and moves valve 220 to its actuated position. Contrariwise, when door 118 is opened (shown in phantom), extension 244 pivots with door 188 and releases push button 222, allowing valve 220 to move back to its unactuated position.

In this embodiment of the invention, door 188 also interacts with a mechanical safety latch 245 that preferably includes a channel section 246 attached against an inside surface 248 of door 188. Channel section 246 is disposed generally parallel with ram rod 252 when door 188 is in the closed position. Latch 245 further includes an extension arm 250 attached to crushing head 58, preferably by an appropriate fastener 252, such as a machine screw. Extension arm 250 is appropriately oriented to move through channel 246 as ram 40 moves downward during the crushing operation. Channel section 246 includes a flange 254 which abuts against extension arm 250 if the person using crushing apparatus 10 attempts to open door 188 during the crushing operation. This feature ensures that door 188 will remain closed during the crushing operation, thus averting any potential for injury. However, even if door 188 were somehow opened, the air supply to air spring 42 would be interrupted as explained above.

Door 188 also includes a handle 256 attached adjacent an exterior door surface 258. Also attached to door 188 is a spring retainer 260 which cooperates with an aperture 262 formed in front mounting member 30 of base 14. When door 188 is closed, retainer 260 is designed to provide a minimal amount of resistance to opening of the door.

Figure 15:
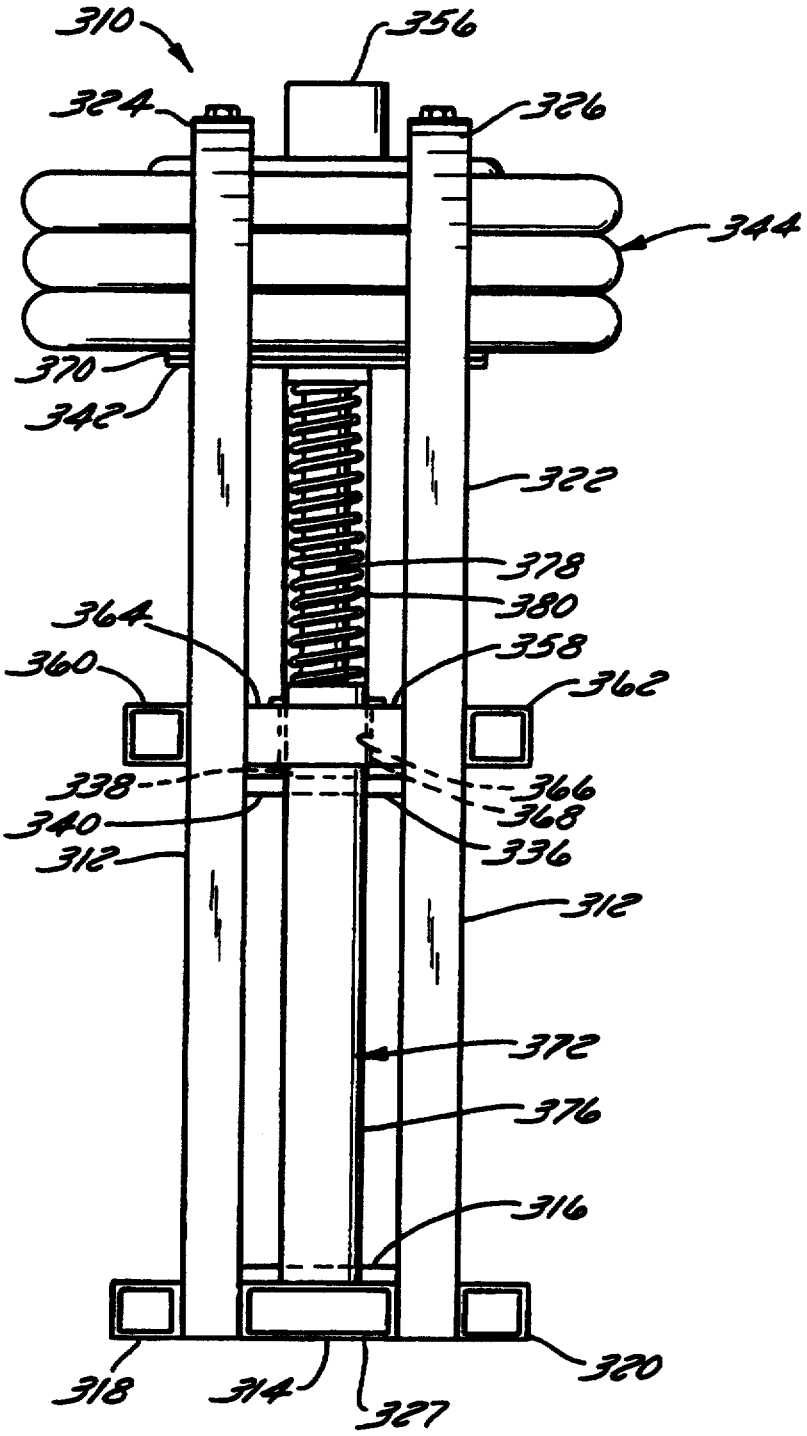
FIG. 15 is a side elevation view of another alternative embodiment of the crushing apparatus.

Another embodiment of the oil filter crushing apparatus is shown in FIG. 15 and is indicated generally by the reference numeral 310. Like the previously described crushing apparatus 10, the crushing apparatus 310 includes a crushing frame 312 having a base portion 314 and an oil filter platform 316. The filter platform 316 may be of the same type as described previously with respect to the crushing apparatus 10. Base portion 314 similarly includes a front mounting member 318 and a back mounting member 320 which each extend horizontally and are spaced from one another.

Frame 312, however, also includes an upper support frame portion 322 having a pair of U-shaped tubular members 324, 326 rather than one. The U-shaped members 324, 326 are likewise welded or otherwise secured to base 314. The U-shaped members 324, 326 are spaced from one another and the base portion 314 is provided with an additional rectangular tubular member 327 provided between U-shaped members 324, 326 and extending generally parallel with mounting members 318 and 320. Filter platform 316 is mounted on the rectangular tubular member 327 at approximately its midway point and may be provided with a through hole (not shown) to provide access to an oil drainage fitting (not shown) similar to that described with respect to crushing apparatus 10.

Apparatus 310 includes a similar ram device 336 having a single central ram rod 338 with a crushing head 340 mounted to its lower end and a pressing plate 342 mounted to its upper end. Ram 336 is of the same construction as that described with respect to the apparatus 10 except that ram rod 338 is larger in diameter to sustain greater crushing loads and has an increased length to provide ram 336 with greater travel or stroke.

A similar air spring-type actuating device 344 is mounted in the same manner as previously described. Actuating device 344 is a larger version of air spring 42 described previously and is available through the same manufacturer. Device 344 is a triple convolute member which has an increased stroke. Apparatus 310 is specifically designed to crush relatively large oil filters used on large trucks and other heavy equipment. Such filters offer a greater resistance to crushing and are more suitably handled by the heavy-duty filter crushing apparatus 310. A control valve 356 is likewise provided to control the flow of the same pressurized fluid into the actuating device 344. Pneumatic circuit 202 could also be adapted for use with crushing apparatus 310.

Frame 312 also includes a ram rod support portion 358 welded to U-shaped members 324, 326 and slidably supporting ram rod 338 between its ends. Support portion 358 likewise includes a front cross member 360 and a back cross member 362. Cross members 360, 362 are spaced from one another and a transverse guide member 364 extends between and is secured to the cross members 360, 362 as shown in FIG. 15. Guide member 364 is preferably of rectangular tubular construction and has a central passageway 366 through which ram rod 338 extends and in which a low friction bushing or sleeve 368 is mounted.

Apparatus 310 also includes an inertia plate 370 and a pair of telescopic spring-loaded guides 372, each having a guide sleeve 376, a plunger rod 378, and a compression spring 380. Guide sleeves 376 are supported by the rectangular base 314 and extend vertically upward therefrom between cross members 360 and 362.

The operation of the crushing apparatus 310 is identical to that described with respect to the crushing apparatus 10 and may likewise include the safety housing, pneumatic circuit, side wall deforming members, various wall mounting features, barrel mounting features, and may likewise be mounted on a similar floor stand of the type previously described.

It should be understood that the foregoing description is of preferred exemplary embodiments of this invention, and that the invention is not limited to the specific forms shown. For example, different materials may be used to construct the frame, different types of valves and components maybe used in the pneumatic circuit, different configurations may be used for the safety housing, and different types of mounting devices may be used to secure the crushing apparatus. These and other modifications may be made in the design and arrangement of the elements without departing from the scope of the invention as expressed in the appended claims.

What is claimed is:

1. An apparatus for crushing used oil filters to reclaim residual oil therefrom before disposing of the filters, said apparatus comprising:

a rigid frame having a base and an oil filter platform cooperating with said base for supporting an oil filter on end;

a ram having a ram rod slidably supported by said frame for longitudinal movement toward and away from said base and a crushing head secured to the end of said rod spaced from said base, the crushing head being configured to engage and crush the oil filter;

an air spring having a rigid first end retaining portion secured to said frame, a rigid second end retaining portion secured to said ram, and an intermediate elastic flex member extending between and interconnecting said retaining portions and defining an enclosed expandable chamber for selectively receiving a pressurized gas therein, wherein the receipt of pressurized gas causes said spring to expand between said frame and said ram to displace said crushing head from an unactuated position to an actuated position, crushing the filter interposed between said crushing head and said base;

a gas supply valve disposed in fluid communication with said enclosed expandable chamber;

a door disposed to limit access to the oil filter platform when said door is in a closed position; and a safety valve disposed for cooperation with said door, said safety valve being configured to prevent gas flow into said enclosed expandable chamber when said door is in an open position.

2. The apparatus of claim 1, wherein said oil filter platform is attached to said base and configured to support and position the oil filter, said platform having a drain hole aperture extending therethrough to drain the residual oil from the filter upon crushing.

3. The apparatus of claim 2, further comprising at least one generally U-shaped tubular member having first and second opposed upstanding leg portions, each secured at free ends thereof to said base member and a connecting portion spaced above said base and integrally joining said leg portions.

4. The apparatus of claim 3, wherein said first end retaining portion is secured to said connecting portion of said U-shaped tubular member and said second end retaining portion is secured to said ram.

5. The apparatus of claim 4, further comprising a ram rod support portion secured to said leg portions intermediate said connecting portion and said base and slidably supporting said ram rod.

6. The apparatus of claim 5, further comprising a passageway in said ram rod support portion through which said ram rod extends and a low friction bushing mounted in said passageway and surrounding said ram rod.

7. The apparatus of claim 5, further comprising a return member acting between said ram and said frame in opposition to said air spring to constantly urge said ram toward said raised unactuated position.

8. The apparatus of claim 7, wherein said return member comprises a pair of telescopic guides disposed on opposite sides of said ram rod and each including a plunger rod secured to a pressing plate at a top end of said ram, a guide sleeve secured to said base, and slidably receiving said plunger rod, and a compression spring carried about said plunger rod and extending between said pressing plate and said base.

9. The apparatus of claim 1, further comprising a filter side wall deforming member configured to move transverse to said ram to engage and inwardly deform a side wall of the oil filter to reduce the oil filter's resistance to end-to-end crushing.

10. The apparatus of claim 9, wherein said filter side wall deforming member comprises a first link member connected to said crushing head, a second link member connected to said frame, and a connection point between said first link and said second link.

11. The apparatus of claim 10, wherein said first link is pivotally connected to said crushing head, said second link is pivotally connected to said frame, and said connection point between said first link and said second link comprises a pivot connection.

12. The apparatus of claim 10, wherein said first link is pivotally connected to said crushing head, said second link is fixed to said frame, and said interconnection between said first link and said second link comprises a slot formed in said second link and a follower pin carried by said first link, said pin being received in said slot and said slot being configured to impart transverse movement to said first linkage when said ram moves towards said actuated position.

13. The apparatus of claim 1, further comprising a floor stand engaging said base for supporting said apparatus off the floor.

14. An apparatus for crushing objects, the apparatus comprising:

a frame having a base for supporting an oil filter or the like on end;

a ram movably mounted within the frame, the ram being configured to move between an unactuated position and an actuated position towards said base;

an air spring mounted within said frame, the air spring including an elastic flex member configured to receive said pressurized gas, wherein upon receipt of said pressurized gas said air spring expands and exerts a force against said ram to move said ram toward said actuated position;

a pressurized gas inlet member connected to the air spring to allow pressurized gas flow into the air spring;

a housing surrounding at least a portion of said frame, said housing having an opening through which the oil filter is moved to place it on said base;

a door pivotably mounted to said housing opening, said door being configured for movement between an open position and a closed position; and a pneumatic safety circuit connected between said gas inlet and said air spring, said pneumatic safety circuit including a supply valve which controls gas flow into said air spring and a door valve that co-operates with said door to prevent the flow of pressurized gas to said air spring when said door is in said open position.

15. The apparatus of claim 14, further comprising a mechanical safety latch which maintains said door in said closed position as said ram moves towards its actuated position.

16. The apparatus of claim 15, wherein said mechanical safety latch includes a channel section attached to said door and an extension arm attached to said ram and disposed to move through said channel section and prevent said door from opening as said ram moves to its actuated position.

17. An apparatus for crushing objects, the apparatus comprising;

a frame having a base for supporting an oil filter or the like on end;

a ram movably mounted within the frame, the ram being configured to move between an unactuated position and an actuated position towards said base;

an air spring mounted within said frame, the air spring including an elastic flex member configured to receive said pressurized gas, wherein upon receipt of said pressurized gas said air spring expands and exerts a force against said ram to move said ram toward said actuated position;

a pressurized gas inlet member connected to the air spring to allow pressurized gas flow into the air spring;

a housing surrounding at least a portion of said frame, said housing having an opening through which the oil filter is moved to place it on said base;

a door pivotably mounted to said housing opening, said door being configured for movement between an open position and a closed position; and a pneumatic safety circuit connected between said gas inlet and said air spring said pneumatic safety circuit including a supply valve which controls gas flow into said air spring and a door valve that co-operates with said door to prevent the flow of pressurized gas to said air spring when said door is in said open position, wherein said pneumatic safety circuit includes a pneumatically actuated supply valve having a pressure sensitive actuator port, said supply valve being actuated by sufficient pneumatic pressure at said actuator port to allow said pressurized gas to flow into said air spring.

18. The apparatus of claim 17, wherein said door valve communicates with said actuator port and blocks the flow of pressurized gas to said actuator port when said door is in said open position.

19. The apparatus of claim 18, wherein said pneumatic circuit includes a push button valve connected in series with said door valve, further wherein said push button valve and said door valve must both be in an actuated position before pressurized gas flows to said actuator port to actuate said supply valve.

20. The apparatus of claim 19, wherein said pneumatic safety circuit includes a pneumatic timer to control the length of time the pressurized gas actuates said supply valve.

21. An apparatus for crushing oil filters, the apparatus comprising:

a frame having a base for supporting an oil filter or the like on end;

a ram movably mounted within the frame, the ram being configured to move between an unactuated position and an actuated position towards said base;

an air spring mounted within said frame, the air spring including an elastic flex member configured to receive said pressurized gas, wherein upon receipt of said pressurized gas said air spring expands and exerts a force against said ram to move said ram toward said actuated position;

a pressurized gas inlet member connected to the air spring to allow pressurized gas flow into the air spring; and a pneumatic timer including an air line and a bleed orifice connected between said pressurized gas inlet and said air spring to control the length of time pressurized gas is supplied to said air spring, wherein the timing is controlled by the volume of said air line and the size of said bleed orifice.

* * * * *